US011051098B2

(12) United States Patent
Kim et al.

(10) Patent No.: US 11,051,098 B2
(45) Date of Patent: Jun. 29, 2021

(54) ELECTRONIC APPARATUS

(71) Applicant: SAMSUNG ELECTRONICS CO., LTD., Suwon-si (KR)

(72) Inventors: Sungjoo Kim, Suwon-si (KR); Jongbae Kim, Suwon-si (KR); Sungha Son, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/731,509

(22) Filed: Dec. 31, 2019

(65) Prior Publication Data

US 2020/0221215 A1 Jul. 9, 2020

(30) Foreign Application Priority Data

Jan. 3, 2019 (KR) ..... 10-2019-0000516

(51) Int. Cl.
*H04R 1/28* (2006.01)
*H04R 1/02* (2006.01)

(52) U.S. Cl.
CPC ..... *H04R 1/288* (2013.01); *H04R 1/025* (2013.01)

(58) Field of Classification Search
CPC ..... H04R 1/2869–2896; H04R 1/288; H04R 1/2888
See application file for complete search history.

(56) References Cited

U.S. PATENT DOCUMENTS 5,590,208 A 12/1996 Koyano et al.
5,900,593 A 5/1999 Adamson
7,433,483 B2 10/2008 Fincham
9,820,034 B1 * 11/2017 Zhang ..... H04R 1/025
2007/0003076 A1 1/2007 Croft, III
(Continued)

FOREIGN PATENT DOCUMENTS

CN 103826183 A 5/2014
GB 2408404 A 5/2005
(Continued)

OTHER PUBLICATIONS

Communication dated May 20, 2020, issued by the European Patent Office in counterpart European Application No. 20150053.5.
(Continued)

*Primary Examiner* — Mark Fischer
(74) *Attorney, Agent, or Firm* — Sughrue Mion, PLLC

(57) ABSTRACT

An electronic apparatus may include a loudspeaker that includes an enclosure; a first driver disposed in the enclosure and configured to output a sound based on an input audio signal; a unit accommodator having a hole in which the first driver is disposed, and extending toward an inside of the enclosure; a space forming portion extended from an outer edge of the unit accommodator, surrounding a back of the first driver to form a space with the unit accommodator, and spaced apart from an inner edge of the unit accommodator; a slot forming portion extending from the space forming portion, and having an inner surface spaced apart from an outer surface of the unit accommodator to form a first sound output passage; and a sound absorber disposed at at least one of the outer surface of the unit accommodator and the inner surface of the slot forming portion.

16 Claims, 32 Drawing Sheets

(56) References Cited

U.S. PATENT DOCUMENTS

| | | | | |
|---|---|---|---|---|
| 2013/0156245 | A1* | 6/2013 | Dix | H04R 1/2873 381/353 |
| 2015/0139466 | A1 | 5/2015 | Kulomaki et al. | |
| 2016/0127822 | A1 | 5/2016 | Zhang et al. | |

FOREIGN PATENT DOCUMENTS

| | | | |
|---|---|---|---|
| JP | H05-56492 | A | 3/1993 |
| JP | H07-288884 | A | 10/1995 |
| JP | 3086270 | B2 | 9/2000 |
| JP | 2011-029808 | A | 2/2011 |
| KR | 10-2013-0127130 | A | 11/2013 |
| WO | 0162043 | A1 | 8/2001 |

OTHER PUBLICATIONS

International Search Report and Written Opinion (PCT/ISA/210 and PCT/ISA/237), dated Apr. 29, 2020 issued by International Searching Authority in International Application No. PCT/KR2019/018716.

* cited by examiner

ELECTRONIC APPARATUS

CROSS-REFERENCE TO RELATED APPLICATION(S)

This application is based on and claims priority under 35 U.S.C. § 119 to Korean Patent Application No. 10-2019-0000516, filed on Jan. 3, 2019 in the Korean Intellectual Property Office, the disclosure of which is incorporated by reference herein in its entirety.

BACKGROUND

1. Field

The disclosure relates to an electronic apparatus, and more particularly, to an electronic apparatus with a loudspeaker.

2. Description of Related Art

Recently, there has been a lot of changes in design of a loudspeaker with the demands for a slim/bezel-less design of an electronic apparatus including the loudspeaker (e.g., a television (TV), a smartphone, an artificial intelligence (AI) loudspeaker, etc.) and a design of a sound system suitable for a certain space, and changes in a listening style such as casual listening, an ambient mode, etc. Among such changes in the loudspeaker, the most salient change is that a slot is formed in front of a diaphragm in a loudspeaker (i.e. a so-called "slot-type loudspeaker"), thereby not only making the electronic apparatus, such as TV, having a slim structure but also making it possible to dispose the loudspeaker behind a panel of the TV.

Referring to FIG. 32, as compared with a loudspeaker 3201, a slot-type loudspeaker 3202 has a peak and a dip in a frequency-response characteristic because resonance and sound tube phenomena occur in the slot, thereby degrading sound quality. As shown in the graph 3210, the peak and the dip of the slot-type loudspeaker 3202 are significantly different by more than 10 dB from an average sound pressure level of the loudspeaker 3201 in a usable frequency band. In particular, the peak and the dip of the slot-type loudspeaker 3202 extend over several kHz in mid-range and tweeter frequency bands, and therefore it is desirable to solve the problem of degrading the sound quality due to the peak and the dip.

SUMMARY

According to an embodiment, there is provided an electronic apparatus including a loudspeaker. The loudspeaker may include an enclosure; a first driver disposed in the enclosure and configured to output a sound based on an input audio signal; a unit accommodator having a hole in which the first driver is disposed, and extending toward an inside of the enclosure; a space forming portion extended from an outer edge of the unit accommodator, surrounding a back of the first driver to form a space with the unit accommodator, and spaced apart from an inner edge of the unit accommodator; a slot forming portion extending from the space forming portion, and having an inner surface spaced apart from an outer surface of the unit accommodator to form a first sound output passage; and a sound absorber disposed at at least one of the outer surface of the unit accommodator and the inner surface of the slot forming portion.

The first driver may be configured to generate a back wave toward the space forming portion where the back wave may travel through the first sound output passage.

The sound absorber may seal the first sound output passage.

The sound absorber may include at least one of an uneven portion and a plurality of slits on the outer surface of the unit accommodator along the first sound output passage.

The unit accommodator may include at least one of a flat plate shape, a polygonal shape, and a rounded flat plate shape.

The unit accommodator may be curved with the first sound output passage.

The enclosure may further include a protrusion extending from the inner surface of the space forming portion, and the protrusion may be a flat plate and may have an end portion of the protrusion spaced apart from the inner edge of the unit accommodator.

The enclosure may further include a port forming a second sound output passage in an area of the space forming portion behind the first driver.

The loudspeaker may include a second driver provided adjacent to the first driver.

The loudspeaker may include a second space forming portion surrounding a back of the second driver.

The electronic apparatus may further include a second driver, and the unit accommodator may further include: a first unit accommodator provided with the first driver to face toward a first inner surface of a first slot forming portion forming the first sound output passage therebetween; and a second unit accommodator comprising a second inner edge spaced apart from a first inner edge of the first unit accommodator, and provided with the second driver to face toward a second inner surface of a second slot forming portion. The second inner surface of the second slot forming portion may form a third sound output passage in an opposite direction to the first sound output passage.

The first driver may be spaced apart at a predetermined distance from the outer edge of the unit accommodator.

The electronic apparatus may further include a third driver provided in a second hole of the space forming portion.

The electronic apparatus may further include a third space forming portion surrounding the back of the first driver, and a second port through which the third space forming portion is connected to the first sound output passage.

The electronic apparatus may further include a display.

According to another embodiment, there is provided a loudspeaker including a driver configured to emit sound; a unit accommodator including the driver and a back slot portion adjacent to the driver; a space forming portion connected to an outer edge of the unit accommodator; a slot forming portion connected to the space forming portion. The slot forming portion may be spaced apart from the unit accommodator and an inner surface of the slot forming portion may face a front side of the driver.

BRIEF DESCRIPTION OF THE DRAWINGS

The above and other aspects, features, and advantages of certain embodiments of the present disclosure will become more apparent from the following description taken in conjunction with the accompanying drawings, in which.

DETAILED DESCRIPTION

Figure 1:
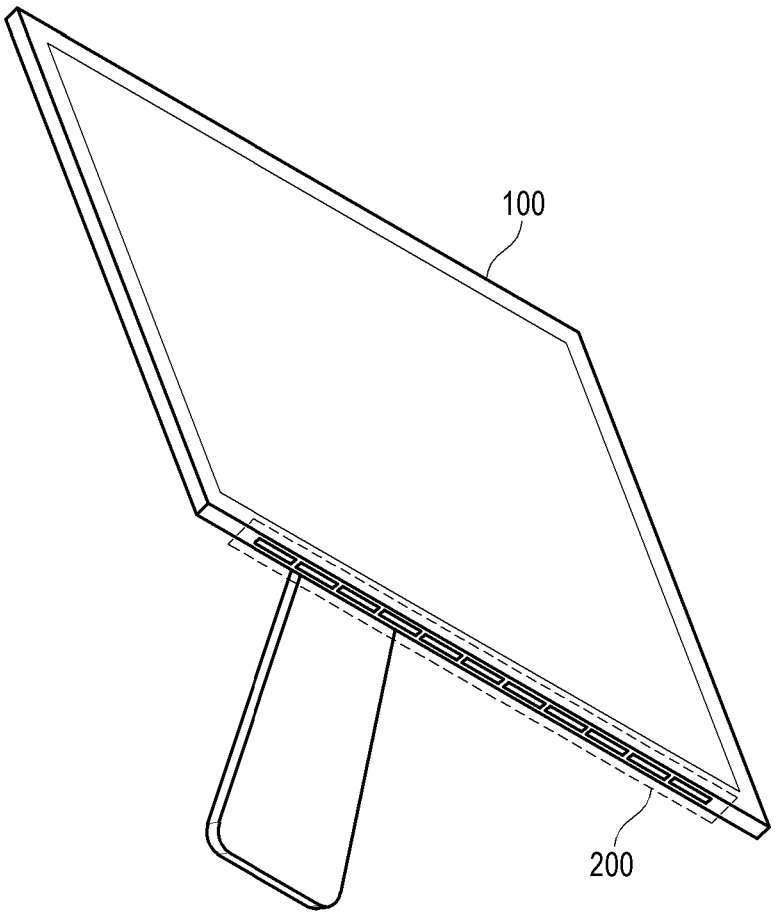
FIG. 1 illustrates an electronic apparatus according to an embodiment.

Embodiments will be described in detail with reference to accompanying drawings. In the drawings, like numerals or symbols may refer to like elements having substantially the same function, and the size of each element may be exaggerated for clarity and convenience of description. However, the configurations and functions illustrated in the following embodiments are not construed as limiting the present disclosure and the key configurations and functions. In the following descriptions, details about publicly known functions or features will be omitted when it is determined that they cloud the gist of the present disclosure.

In the following embodiments, terms 'first', 'second', etc. are used to distinguish one element from another, and singular forms may include plural forms unless otherwise stated in the context. In the following embodiments, it may be understood that terms 'comprise', 'include', 'have', etc. do not preclude the presence or addition of one or more other features, numbers, steps, operations, elements, components or combination thereof. In addition, it will be understood in the following embodiments that terms 'upper', 'lower', 'left', 'right', 'inward', 'outward', 'inside', 'outside', 'front', 'back', etc. are defined with reference to the accompanying drawings and do not limit the shape or position of the elements. Further, in the following embodiments, at least one among a plurality of elements may refer to not only all of the plurality of elements, but also each element among the plurality of elements excluding the other elements or a combination of the plurality of elements.

FIG. 1 illustrates an electronic apparatus 100 according to an embodiment. As shown in FIG. 1, the electronic apparatus 100 may be a display apparatus, for example, a television (TV), a smartphone, a notebook computer, a tablet computer, etc. However, the electronic apparatus 100 is not limited to the display apparatus, but may include any apparatus with a loudspeaker to output a sound, for example, an artificial intelligence (AI) loudspeaker, etc. Further, the electronic apparatus 100 may include electronic circuits necessary to provide image and acoustic signals to the display apparatus and one or more loudspeakers, respectively.

The electronic apparatus 100 includes a loudspeaker 200. The loudspeaker provided in the electronic apparatus 100 may include a slot-type loudspeaker. Here, the slot-type loudspeaker may refer to a loudspeaker of which an opening for outputting a sound may be smaller than a diaphragm, without being restricted by the terms. The loudspeaker 200 may be positioned in a lower portion of the electronic apparatus 100 and output a sound in a downward direction from the bottom of the electronic apparatus 100. However, there are no limits to the position of the loudspeaker 200 provided in the electronic apparatus 100 and the sound output direction of the loudspeaker 200.

Figure 2:
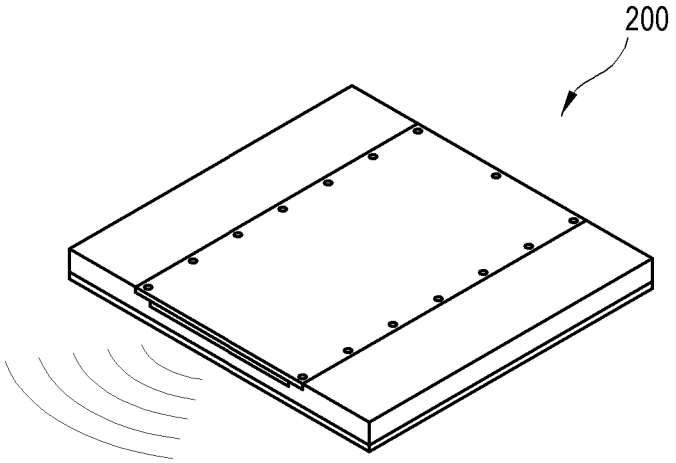
FIG. 2 illustrates a perspective view of a loudspeaker according to an embodiment.
Figure 3:
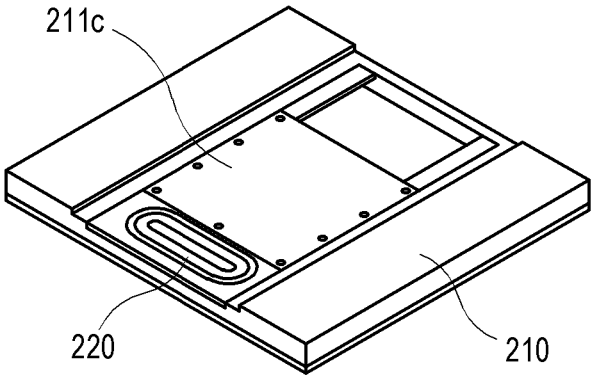
FIG. 3 illustrates a perspective view of a loudspeaker without a slot forming portion according to an embodiment.
Figure 4:
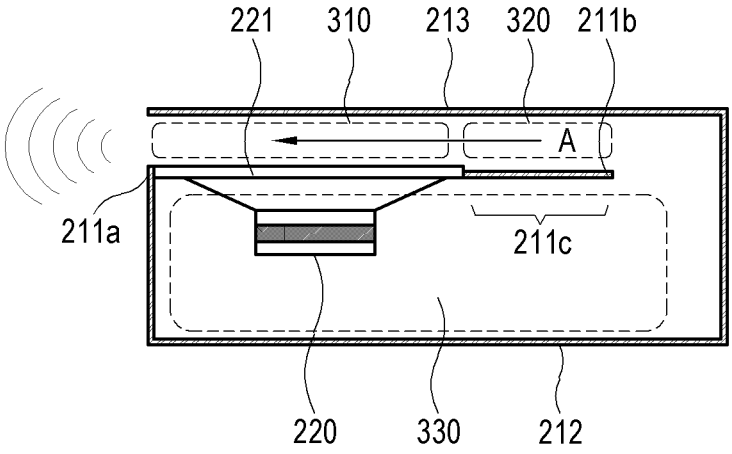
FIG. 4 illustrates a lateral cross-section view of a loudspeaker according to an embodiment.

FIGS. 2, 3, and 4 illustrate a loudspeaker according to an embodiment. FIG. 2 is a perspective view of a loudspeaker 200 according to an embodiment, FIG. 3 is a perspective view of the loudspeaker 200 without a slot forming portion according to an embodiment, and FIG. 4 is a lateral cross-section view of the loudspeaker 200 according to an embodiment.

The loudspeaker 200 may include an enclosure 210 and a driver 220.

The enclosure 210 may refer to a structure forming a shape of the loudspeaker 200, and may accommodate the driver 220. There are no specific limits to the shape and material of the enclosure 210.

The driver 220 may output a sound based on an input audio signal. Here, the driver 220 may also be called a unit or a driver unit. The driver 220 may be provided inside the enclosure 210 or along the enclosure 210. Further, there may be a single or a plurality of drivers 220. The drivers 220 may be called a first driver, a second driver, etc. to distinguish among the plurality of drivers 220. The driver 220 may include a diaphragm 221, a driving circuit, etc., to output a sound based on an input audio signal.

The enclosure 210 may include a unit accommodator 211, a space forming portion 212, and a slot forming portion 213.

The unit accommodator 211 accommodates the driver unit 220. The unit accommodator 211 may be a flat plate, but there are no limits to the shape of the unit accommodator 211. For example, the unit accommodator 211 may be a curved plate. The unit accommodator 211 may extend toward the inside of the enclosure 210. The unit accommodator 211 may include a hole in which the first driver 220 may be disposed. There are no limits to the position of the first driver 220 in the hole of the unit accommodator 211. For example, the first driver 220 may be positioned close to an outer edge 211*a* of the unit accommodator 211. In such case, an area of the unit accommodator 211, in which the first driver 220 is not accommodated, is biased toward an inner edge 211*b* of the unit accommodator 211. Alternatively, the first driver 220 may be spaced at a predetermined distance from the outer edge 211*a* of the unit accommodator 211. Herein, a portion of the unit accommodator 211 between the inner edge 211*b* of the unit accommodator 211 and the first driver 220 will be called a back-slot portion 211*c*. Further, a portion of a first sound output passage A, which corresponds to the back-slot portion 211*c*, will be called a 'back-slot' 320.

The space forming portion 212 extends from the outer edge 211*a* of the unit accommodator 211. For example, the space forming portion 212 and the unit accommodator 211 may be formed as a single body, and the space forming portion 212 may be bent and extend from the outer edge 211*a* of the unit accommodator 211. Alternatively, the extension of the space forming portion 212 from the unit accommodator 211 may mean that the space forming portion 212 and the unit accommodator 211 are separately provided and coupled to each other at the outer edge 211*a*. The space forming portion 212 may form a space together with an inner surface of the unit accommodator 211, while enclosing the first driver 220. That is, the back of the first driver 220 may be attached to the inner surface of the unit accommodator 211 and protrude toward the space forming portion 212. The space formed between the space forming portion 212 and the inner surface of the unit accommodator 211 will be called a chamber 330. The shape of the space forming portion 212 is not limited to a specific shape. For example, the space forming portion 212 may be a flat plate, a curved plate, etc.

The space forming portion 212 may be spaced apart from the inner edge 211*b* of the unit accommodator 211. Therefore, a space is formed between the space forming portion 212 and the inner edge 211*b* of the unit accommodator 211. In this space, any sound generated from the driver 220 (e.g., back wave) may travel from the chamber 330 through the back-slot 320.

The slot forming portion 213 may extend from the space forming portion 212. For example, the slot forming portion 213 and the space forming portion 212 may be formed as a single body, and the slot forming portion 213 may be bent and extend from the end of the space forming portion 212. Alternatively, the extension of the slot forming portion 213 from the space forming portion 212 may be extended such that the slot forming portion 213 and the space forming portion 212 are separately provided and coupled to each other by the extension. The slot forming portion 213 may be disposed in front of the first driver 220. Further, the slot forming portion 213 may be spaced apart from and disposed in parallel to the outer surface of the unit accommodator 211. Therefore, the first sound output passage A, through which a sound is output, may be formed between the slot forming portion 213 and the unit accommodator 211. A portion of the first sound output passage A, which corresponds to the diaphragm 221 of the driver 220, will be called a 'slot' 310. The shape of the slot forming portion 213 is not limited to a specific shape. For example, the slot forming portion 213 may be a flat plate, a curved plate, etc.

In the foregoing structure of a loudspeaker 200, the back-slot 320 may be disposed between the chamber 330 and the slot 310, and the sound may travel from the chamber 330 through the back-slot 320 toward the slot 310 as shown in FIG. 4. Thus, a sound output from the driver 220 may have an additional sound path of the back-slot 320 and the chamber 330 in addition to the slot 310, and therefore sound-quality degradation caused by a peak and a dip may be further mitigated than that of the slot-type loudspeaker having only the sound path similar to that of the slot 310.

Further, a sound wave generated in back of the driver 220 (hereinafter, referred to as a 'back wave') may pass through the first sound output passage A. Specifically, the back wave generated from the driver 220 may pass through the chamber 330 and the back-slot 320, and combine with a sound wave output in front of the diaphragm of the driver 220 (hereinafter, referred to as a 'front wave') in the slot 310, so that a higher-quality sound may be output from the loudspeaker 200. Thus, a sound output from the loudspeaker 200 may be improved in bass-range sound quality.

Figure 5:
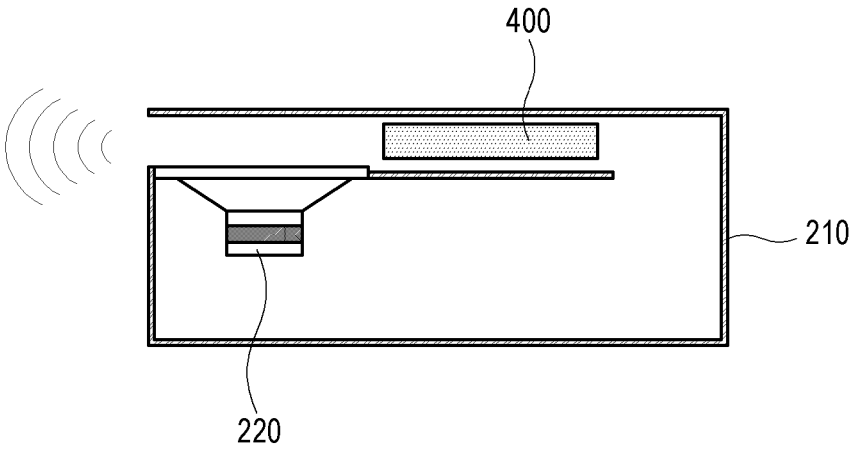
FIG. 5 illustrates a lateral cross-section view of a loudspeaker according to another embodiment.
Figure 6:
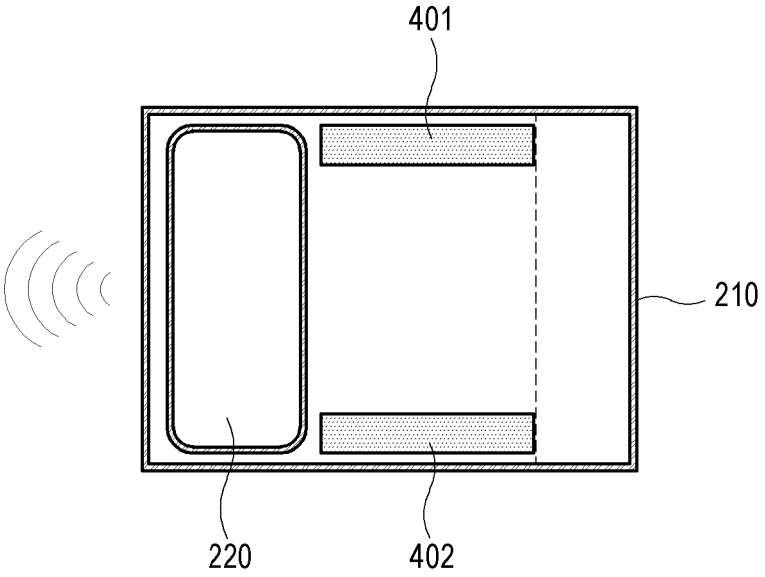
FIG. 6 illustrates a plan cross-section view of a loudspeaker according to another embodiment.
Figure 7:
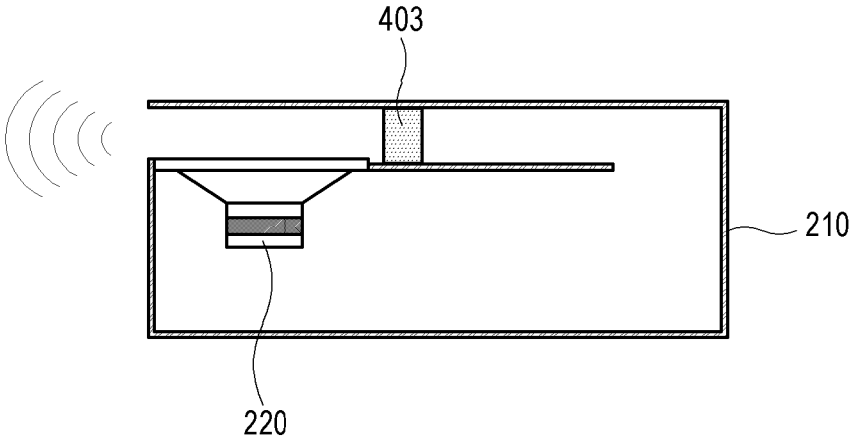
FIG. 7 illustrates a lateral cross-section view of a loudspeaker according to still another embodiment.
Figure 8:
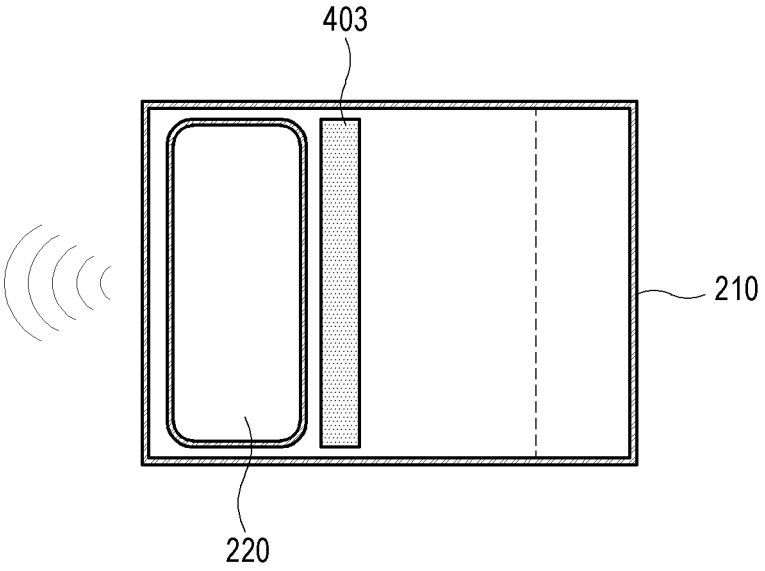
FIG. 8 illustrates a plan cross-section view of a loudspeaker according to still another embodiment.
Figure 9:
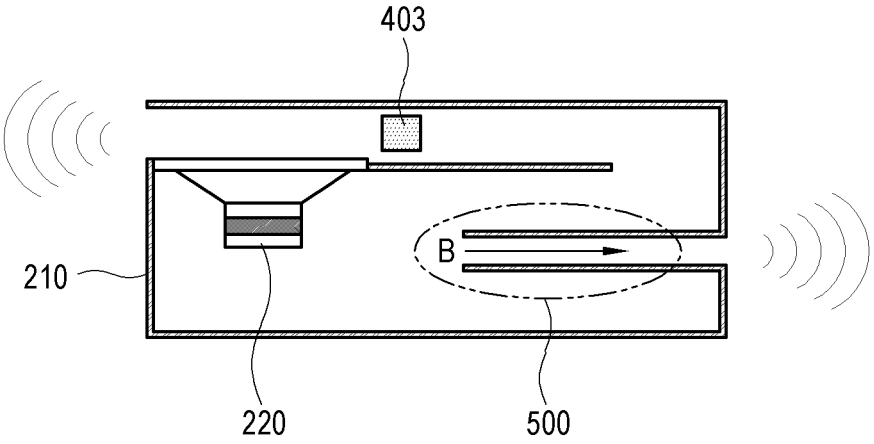
FIG. 9 illustrates a lateral cross-section view of a loudspeaker according to still another embodiment.

FIGS. 5 to 9 illustrate a loudspeaker 200 according to embodiments. FIG. 5 is a lateral cross-section view of a loudspeaker according to another embodiment, FIG. 6 is a plan cross-section view of the loudspeaker according to another embodiment, FIG. 7 is a lateral cross-section view of a loudspeaker according to still another embodiment, FIG. 8 is a plan cross-section view of the loudspeaker according to still another embodiment, and FIG. 9 is a lateral cross-section view of a loudspeaker according to still another embodiment.

According to embodiments, the loudspeaker 200 may include a sound absorber 400, which is not included in the embodiments described in FIGS. 2 to 4. The sound absorber 400 is not specially restricted in terms of material, shape, form, composition, configuration, etc. For example, the sound absorber 400 may include a sound absorption material or a sound metamaterial. Alternatively, the sound absorber 400 may be embodied as an object having an uneven portion, a slit, or the like shape. However, when the sound absorber 400 is embodied as an object having an uneven portion, a slit, or the like shape, the sound absorber 400 may serve as a means for controlling a frequency characteristic of a space in which the sound absorber 400 is placed, instead of or in addition to a function of absorbing a sound.

A sound wave, which may have a wavelength not longer than twice a total length of the back-slot 320 and the slot 310, among sound waves generated in the back of the driver 220 may easily pass through the back-slot 320 and the slot 310, and may be distorted by a standing wave generated inside the back-slot 320 and the slot 310. On the other hand, according to an embodiment with the sound absorber 400, such distortion of sound quality due to the standing wave may be reduced, and thus the quality of sound output from the loudspeaker 200 may be improved.

The sound absorber 400 may be provided in at least one of the outer surface of the unit accommodator 211 or the inner surface of the slot forming portion 213. When the sound absorber 400 may be provided in at least one of the outer surface of the unit accommodator 211 or the inner surface of the slot forming portion 213, there are no specific limits to the position and shape of the sound absorber 400. For example, as shown in FIGS. 5 and 6, the sound absorber 400 may be provided as two sound absorbers 401 and 402 having the same length as the back-slot 320 and respectively contacting the opposite sides of the first sound output passage A. Alternatively, as shown in FIGS. 7 and 8, a sound absorber 403 may be provided to seal up the first sound output passage A. In the latter case, the first sound output passage A is sealed up with the sound absorber 403 as compared with the former case where the sound absorbers 401 and 402 do not seal up the first sound output passage A, thereby further reducing the distortion of the sound quality due to the standing wave. Here, 'sealing up' the sound output passage with the sound absorber 403 may mean that the sound output passage is blocked by the shape of the sound absorber 403. Therefore, for example, when the sound absorber 403 itself is permeable, air can pass through the sound output passage via the sound absorber 403 even though the sound output passage is sealed up with the sound absorber 403. That is, flow of air is not completely prevented in the sound output passage even though the sound output passage is sealed up with the sound absorber 403.

Figure 26:
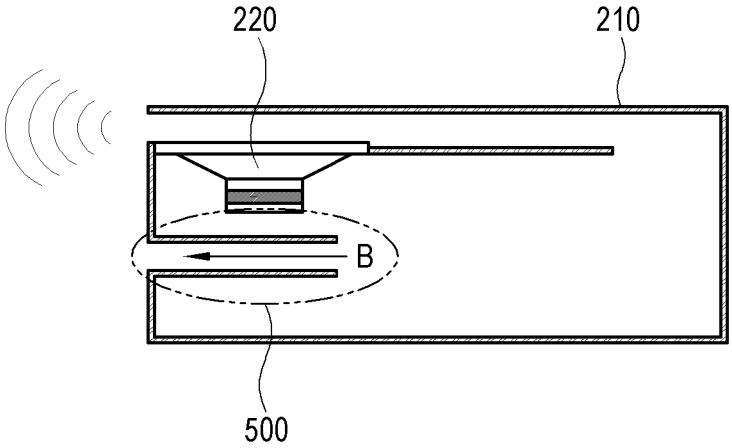
FIG. 26 illustrates a lateral cross-section view of a loudspeaker including another port according to another embodiment.

Further, as shown in FIG. 9, the loudspeaker 200 may additionally include a port 500 in a certain area of the space forming portion 212, to form a second sound output passage B. The port 500 allows the back wave sound in the chamber to be emitted toward the outside through the second sound output passage B in addition to the first sound output passage A. However, there are no limits to the position or orientation of the port 500. For example, as shown in FIG. 26, the port 500 may be provided in a certain area behind the first driver 220 of the space forming portion 212, unlike that of FIG. 9, and oriented in an opposite direction to that of FIG. 9, thereby forming the second sound output passage B in the opposite direction to that of FIG. 9.

The bass-range sound quality of the sound output from the loudspeaker 200 is generally improved by the port 500, and thus the back-slot 320 may contribute to reducing the distortion of the sound due to the slot-type loudspeaker structure and the port 500 improving the bass-range sound quality, thereby improving the overall sound quality.

Figure 10:
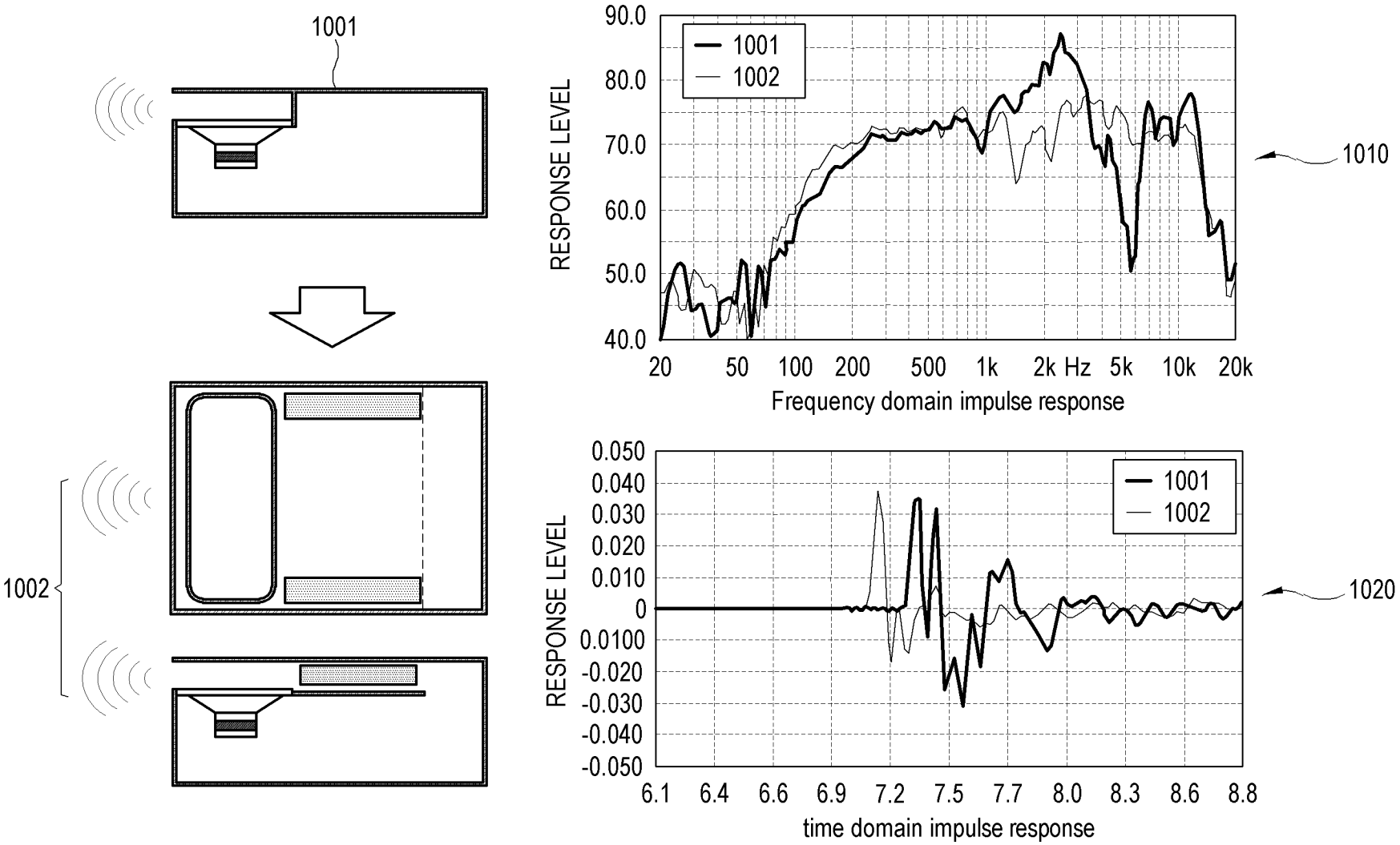
FIG. 10 shows graphs illustrating effects according to embodiments.
Figure 11:
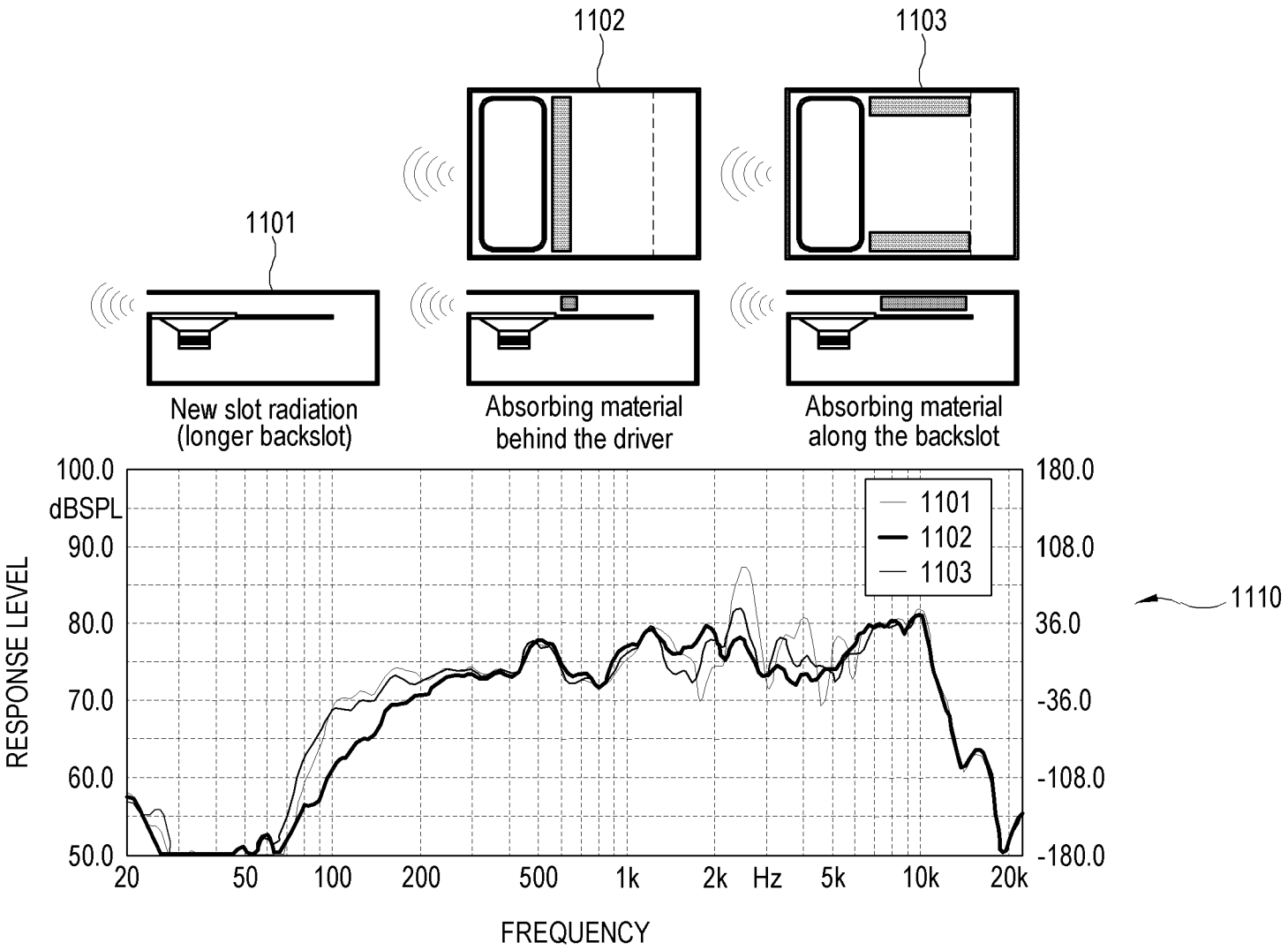
FIG. 11 shows graphs illustrating effects according to embodiments.

FIGS. 10 and 11 show graphs illustrating effects according to embodiments.

FIG. 10 is a graph 1010 showing a response characteristic in a frequency domain and a graph 1020 showing a response characteristic in a time domain for comparison between a conventional slot-type loudspeaker and a loudspeaker according to an embodiment of the disclosure. It may be appreciated that a loudspeaker 1002 according to an embodiment may improve sound quality with respect to the response characteristics in the frequency and time domains as compared with those of a conventional slot-type loudspeaker 1001 having no additional sound path of the back-slot 320 and the chamber 330.

In particular, a peak/dip decreasing rate in the embodiment with the sound absorber 400 may be less than that of a loudspeaker with no sound absorber, and this is illustrated in FIG. 11. FIG. 11 is a graph 1110 showing a comparison in an output sound between a loudspeaker 1101 without a sound absorber, and loudspeakers 1102 and 1103 with the sound absorber 400. In the graph 1110, it may be seen that the peak/dip of the loudspeakers 1102 and 1103 vary less than that of the loudspeaker 1101. Thus, it may be appreciated that a peak/dip decreasing rate in the loudspeakers 1102 and 1103 with the sound absorber 400 is less than that of the loudspeaker 1101 without a sound absorber.

FIGS. 12 to 31 illustrate various embodiments.

The sound absorber 400 according to an embodiment may be provided on the outer surface of the unit accommodator 211 to form at least one of an uneven portion or a slit along the first sound output passage A. In this regard, description will be made with reference to FIGS. 12 to 17.

Figure 12:
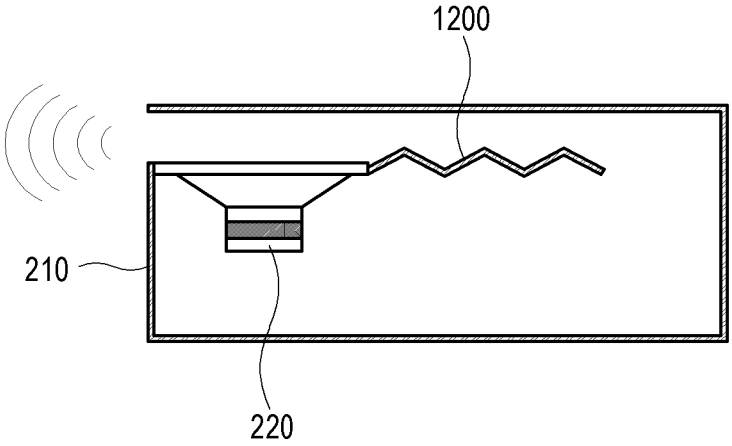
FIG. 12 illustrates a lateral cross-section view of a loudspeaker according to an another embodiment.
Figure 13:
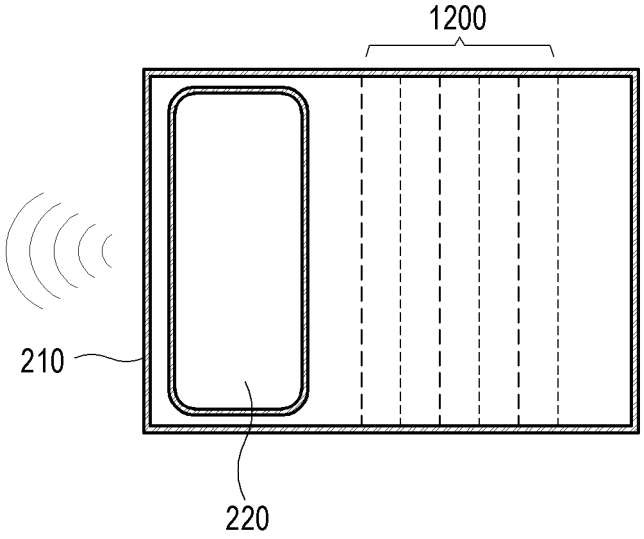
FIG. 13 illustrates a plan cross-section view of the embodiment shown in FIG. 12.

FIGS. 12 and 13 illustrate an embodiment in which an uneven portion 1200 is formed on the outer surface of the unit accommodator 211 along the first sound output passage A (FIG. 12 is a lateral cross-section view, and FIG. 13 is a plan cross-section view). FIGS. 12 and 13 illustrate an embodiment that the uneven portions 1200 are repetitively formed at regular intervals, but the disclosure is not limited hereto. Alternatively, the uneven portion may be formed at irregular intervals or without repetition.

Figure 14:
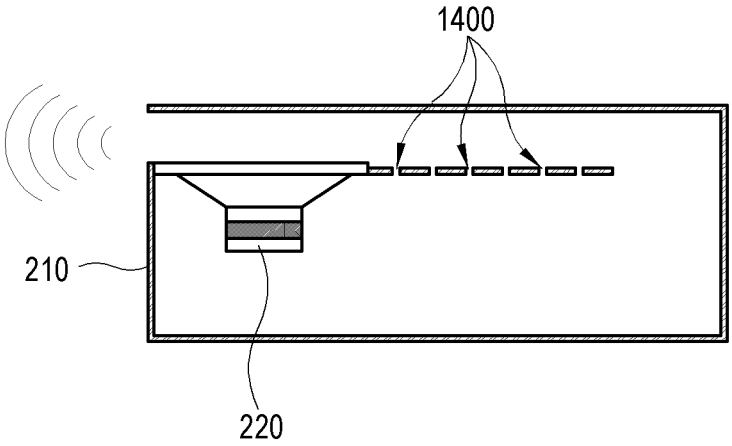
FIG. 14 illustrates a lateral cross-section view of a loudspeaker according to another embodiment.
Figure 15:
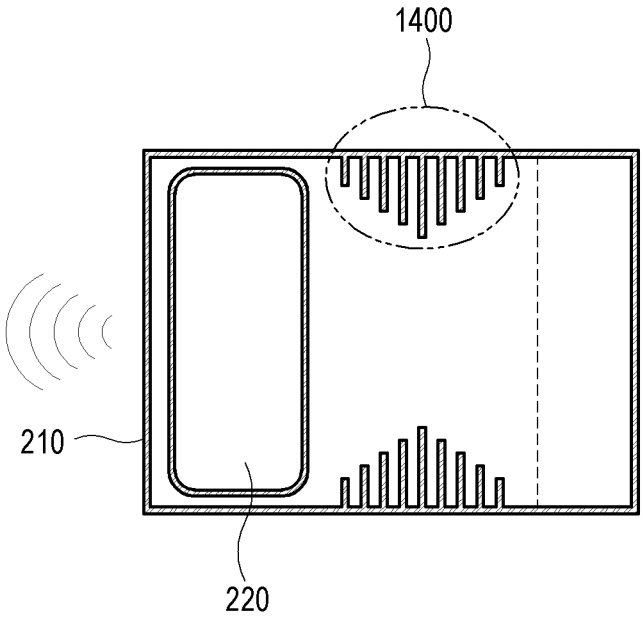
FIG. 15 illustrates a plan cross-section view of the embodiment shown in FIG. 14.
Figure 21:
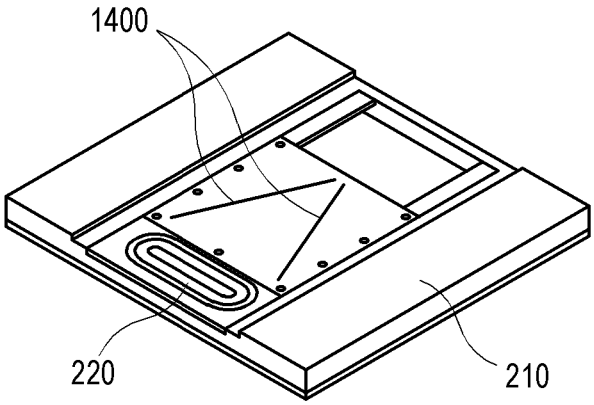
FIG. 21 illustrates a perspective view of a unit accommodator implemented in the embodiment shown in FIGS. 14 and 15.

FIGS. 14 and 15 illustrate an embodiment in which slits 1400 are formed on the outer surface of the unit accommodator 211 along the first sound output passage A (FIG. 14 is a lateral cross-section view, and FIG. 15 is a plan cross-section view). FIGS. 14 and 15 illustrate an embodiment that the slits 1400 are formed at regular intervals, but the disclosure is not limited to this embodiment. Further, FIGS. 14 and 15 illustrate that the slits are formed along the first sound output passage A, in a direction perpendicular to the longitudinal direction of the first sound output passage A. However, there are no limits to the position and direction of the slits 1400. For example, the slits formed on the outer surface of the unit accommodator 211 may have the shape as shown in FIG. 21.

Figure 16:
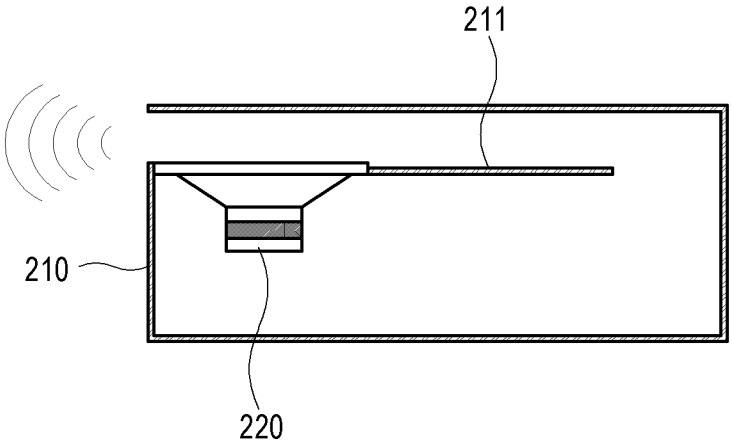
FIG. 16 illustrates a lateral cross-section view of a loudspeaker according to still another alternative embodiment.
Figure 17:
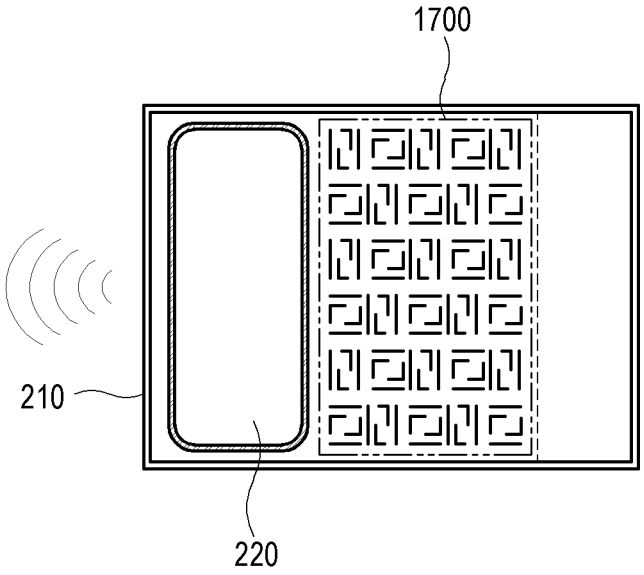
FIG. 17 illustrates a plan cross-section view of the embodiment shown in FIG. 16.

FIGS. 16 and 17 illustrate an embodiment in which a predetermined pattern 1700 is formed on the outer surface of the unit accommodator 211 along the first sound output passage A (FIG. 16 is a lateral cross-section view, and FIG. 17 is a plan cross-section view). FIGS. 16 and 17 illustrate an embodiment in which the patterns 1700 are repetitively formed having a straight or bent shape, but the disclosure is not limited to this embodiment. Alternatively, a predetermined pattern may be formed having a curved shape or without repetition.

Although FIGS. 12 to 17 illustrate the embodiments in which uneven portions, slits or patterns are formed on the outer surface of the unit accommodator 211, the disclosure is not limited to these embodiments. Alternatively, the uneven portions, slits or patterns may be formed on any place in contact with or near the first sound output passage A. For example, the uneven portion, slits, patterns, etc. may be formed on the inner surface of the slot forming portion 213.

Thus, as compared with the loudspeaker in which the outer surface of the unit accommodator 211, the inner surface of the slot forming portion 213, etc. are flat without the uneven portions, the slits, the patterns, etc., the loudspeaker 200 may be configured in various forms to generate various sound modes in the back-slot portion 211*c*, thereby further reducing a distortion of sound quality. That is, when the sound absorber 400 is embodied as an object shaped to have the uneven portions, the slit, various patterns, etc., the sound absorber 400 may serve as a means for controlling a frequency characteristic of a space in which the sound absorber 400 is placed, instead of or in addition to a function of merely absorbing a sound.

The unit accommodator 211 may be shaped like a polygonal or rounded flat plate. In this regard, descriptions will be made with reference to FIGS. 18 to 21.

Figure 18:
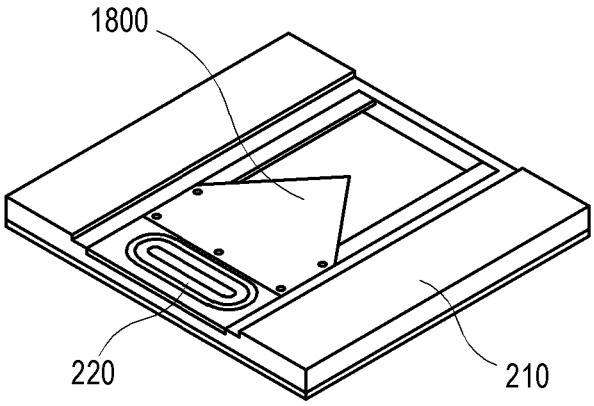
FIG. 18 illustrates a perspective view of a unit accommodator in a triangular flat plate shape according to an embodiment.

FIG. 18 illustrates an embodiment in which a portion 1800 of the unit accommodator 211 is shaped like a triangular flat plate. However, the disclosure is not limited hereto. Alternatively, for example, the unit accommodator 211 itself may be a triangular flat plate, or may be formed as a triangular flat plate aligned in a different direction from that of FIG. 18, or may be embodied as a flat plate having other polygonal shapes other than the triangular shape.

Figure 19:
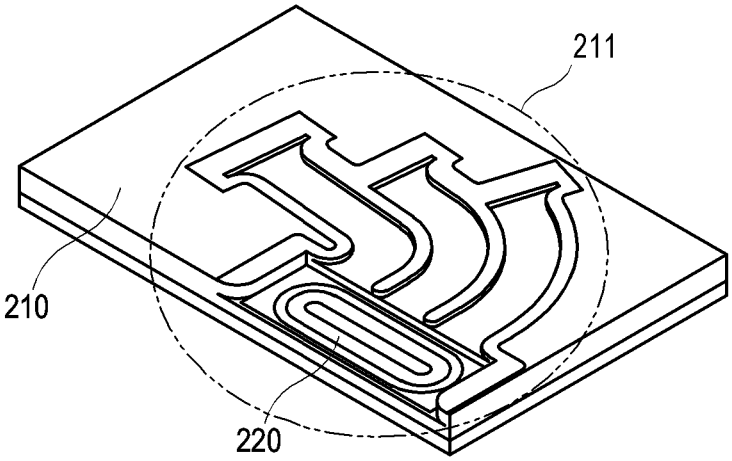
FIG. 19 illustrates a perspective view of a unit accommodator in a rounded flat plate shape according to an embodiment.
Figure 20:
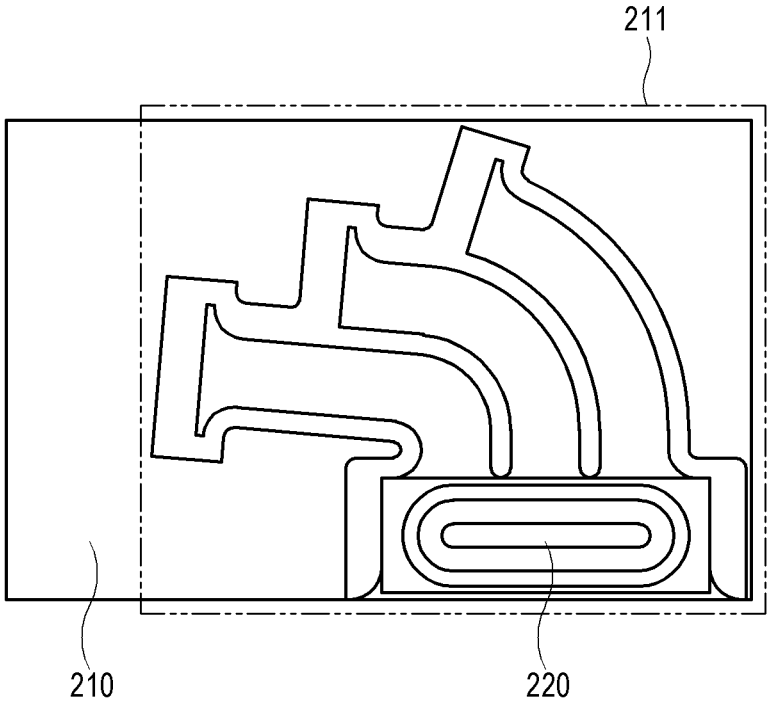
FIG. 20 illustrates a plan view of the unit accommodator shown in FIG. 19.

FIGS. 19 and 20 illustrate an embodiment in which the unit accommodator 211 has a rounded flat plate (FIG. 19 is a perspective view without the slot forming portion 213, and FIG. 20 is a plan view). Further, FIGS. 19 and 20 illustrate an embodiment in which the unit accommodator 211 includes not a single flat plate but three partitioned flat plates. However, the disclosure is not limited to this embodiment. For example, the unit accommodator 211 may include a different rounded plate from that of FIGS. 19 and 20, partitioned into another number of flat plates, or include unpartitioned flat plates.

Thus, various sound modes may be rendered in the back-slot portion 211*c*, thereby further reducing a distortion of sound quality.

According to an embodiment, the unit accommodator 211 may be provided with a curved first sound output passage A. In this regard, descriptions will be made with reference to FIGS. 22 and 23.

Figure 22:
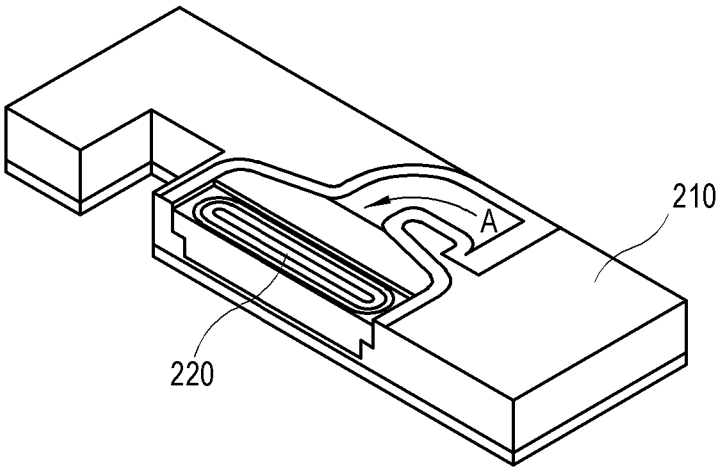
FIG. 22 illustrates a perspective view of a unit accommodator according to another embodiment.
Figure 23:
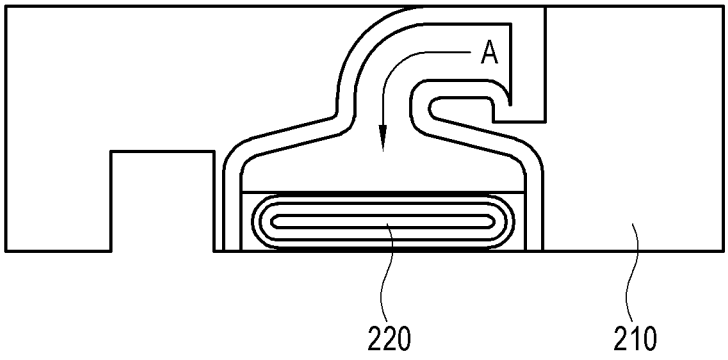
FIG. 23 illustrates a plan view of the embodiment shown in FIG. 22.

FIGS. 22 and 23 illustrate an embodiment in which the first sound output passage A may be curved toward the driver 220. Further, FIGS. 22 and 23 illustrate an embodiment that the first sound output passage A decreases in width toward the driver 220, thereby gradually decreasing the cross-sectional area of the first sound output passage A. However, the disclosure is not limited to this embodiment. Alternatively, the curved direction of the first sound output passage A may be different from that of FIGS. 22 and 23. Further, variation in the cross-sectional area of the first sound output passage A may be rendered, different from that of FIGS. 22 and 23.

Thus, various sound modes may be rendered in the back-slot portion 211*c*, thereby further reducing a distortion of sound quality.

Figure 24:
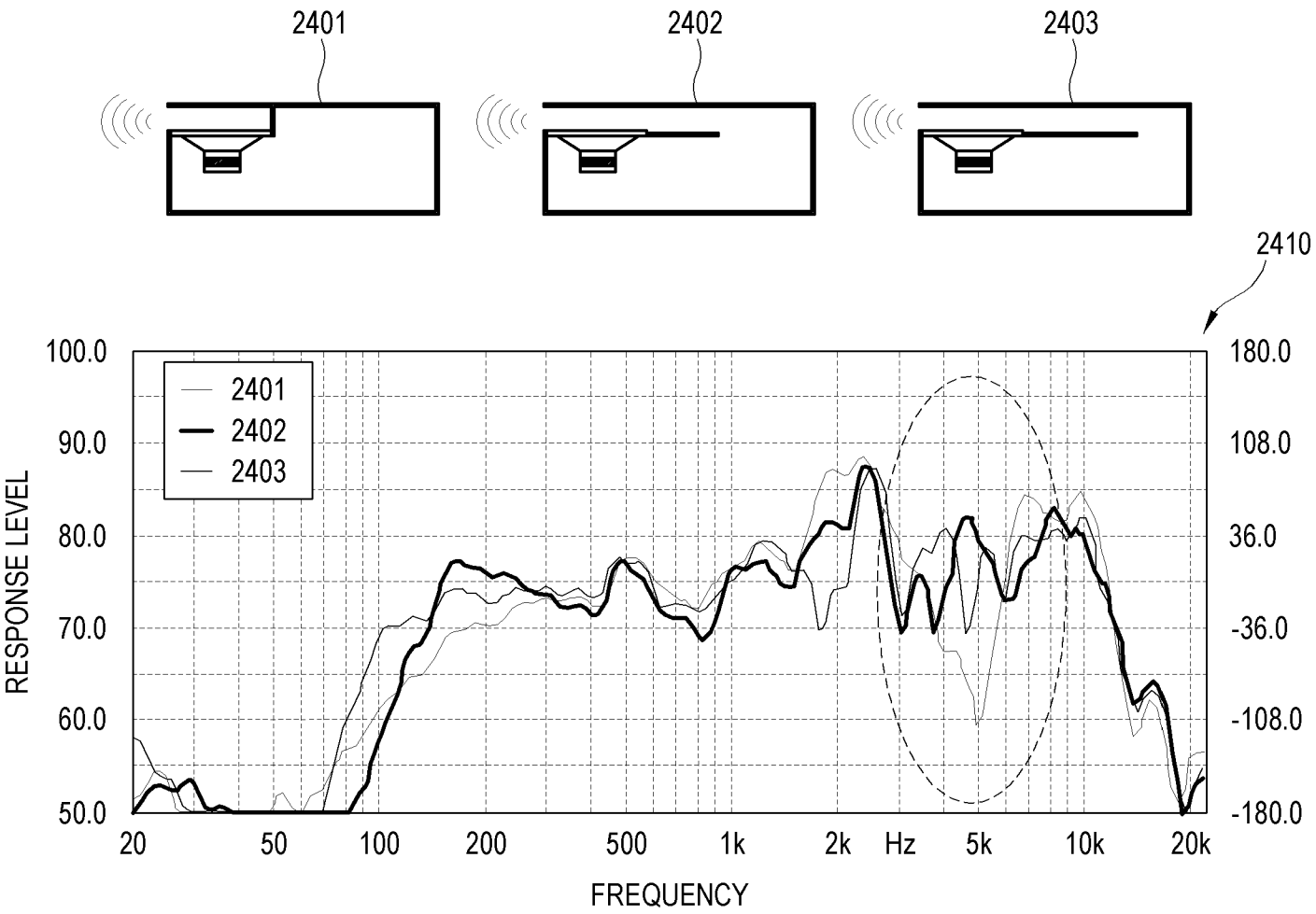
FIG. 24 shows graphs illustrating effects of variable lengths of a back slot portion of a loudspeaker according to various embodiments.

According to an embodiment, the length of the back-slot portion 211*c* may vary. In this regard, descriptions will be made with reference to FIG. 24. FIG. 24 illustrates a loudspeaker 2401 in which the back-slot portion 211*c* is not present, a loudspeaker 2402 in which the back-slot portion 211*c* is relatively short, a loudspeaker 2403 in which the back-slot portion 211*c* is relatively long. A graph 2410 shows a comparison in frequency-response characteristic of an output sound among the loudspeakers 2401, 2402, and 2403. Referring to FIG. 24, it may be understood that a degree of reducing a peak/dip and general characteristics of the output sound may vary depending on the presence of the back-slot portion 211*c* and the length of the back-slot portion 211*c*. Therefore, the loudspeaker 200 may be designed by properly changing the length of the back-slot portion 211*c* according to desired sound quality.

Figure 25:
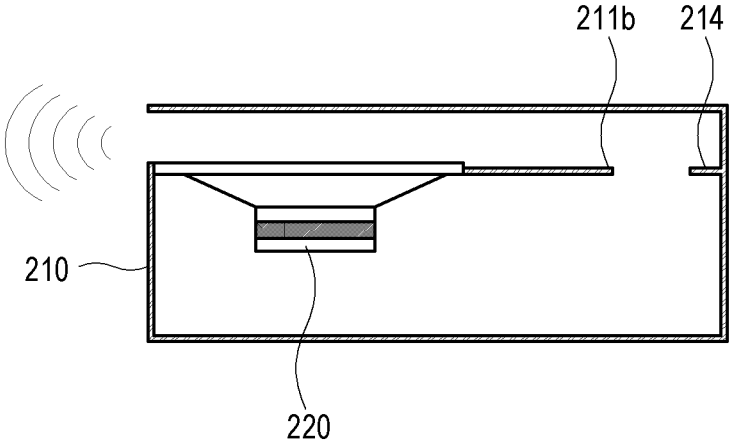
FIG. 25 illustrates a lateral cross-section view of a loudspeaker including a protrusion according to an embodiment.

Referring to FIG. 25, the enclosure 210 may include a protrusion 214 in a plate shape extending from the inner surface of the space forming portion 212, and having an end portion spaced apart from the inner edge 211*b* of the unit accommodator. In comparison with the foregoing loudspeaker described with reference to FIG. 4, the loudspeaker of FIG. 25 may include the protrusion 214 partially blocking a passage connecting the back-slot 320 and the chamber 330.

Accordingly, various sound modes may be rendered in the back-slot portion 211*c* or around the back-slot portion 211*c*, thereby further reducing a distortion of sound quality.

Referring to FIG. 26, the enclosure 210 may further include the port 500 forming the second sound output passage B, through which the back wave sound in the chamber is emitted toward the outside. The port 500 may be disposed in a region behind the first driver 220 of the space forming portion 212. However, as described with reference to FIG. 9, there are no limits to the position and direction of the port 500.

Thus, a sound output from the loudspeaker 200 may be improved in bass-range sound quality.

Figure 27:
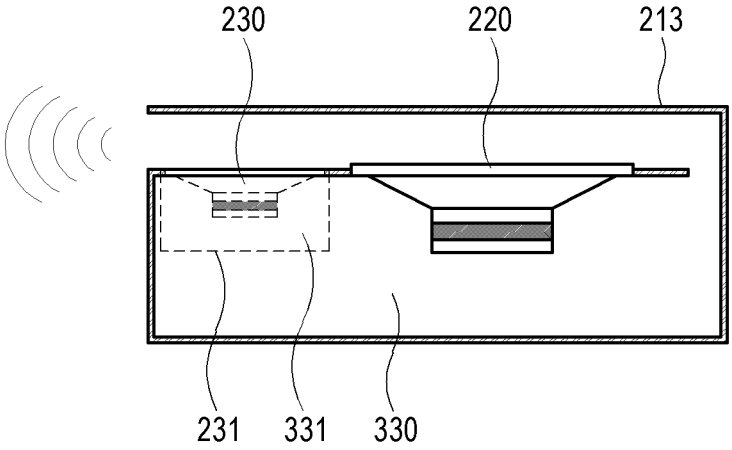
FIG. 27 illustrates a lateral cross-section view of a loudspeaker including a second driver according to another embodiment.

In addition, the unit accommodator 211 according to an embodiment may include a second driver 230 provided adjacent to the first driver 220 toward the outer edge of the unit accommodator 211, which is illustrated in FIG. 27. The drivers 220 and 230 may receive audio signals of different ranges. Accordingly, the loudspeaker 200 may further include a network circuit to respectively distribute the audio signals to the drivers 220 and 230.

Thus, signals of different ranges are respectively provided to the drivers to provide a sound of improved sound quality.

Furthermore, the unit accommodator 211 may further include a second space forming portion 231 surrounding the back of the second driver 230. When the second space forming portion 231 is not present, the second driver 230 and the first driver 220 may share one chamber 330 with each other. On the other hand, when the second space forming portion 231 surrounding the back of the second driver 230 is present, the first driver 220 may have the first chamber 330 and the second driver 230 may have a second chamber 331. That is, the second driver 230 may have a separate chamber 331 independently of the first driver 220. In the latter case, a sound wave generated in back of the second driver 230, i.e., a second back wave, does not radiate to the outside of the loudspeaker 200, and therefore a sound output from the second driver 230 is not reinforced with respect to a bass-range sound.

Thus, when the sound output from the second driver 230 is not reinforced with respect to the bass-range sound, the loudspeaker 200 may provide a sound with proper sound quality and characteristic suitable for various circumstances.

Figure 28:
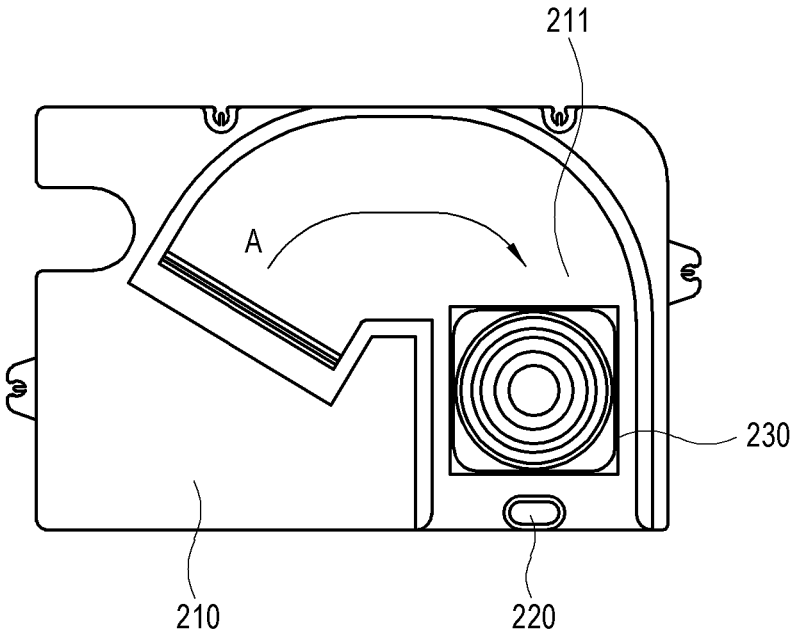
FIG. 28 illustrates a plan view of the embodiment shown in FIG. 27.
Figure 29:
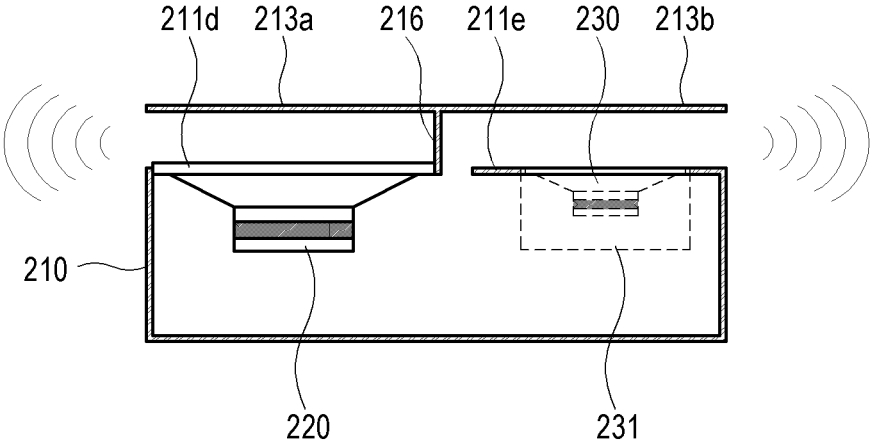
FIG. 29 illustrates a lateral cross-section view of a loudspeaker including a second driver with a second output according to another embodiment.

Meanwhile, the foregoing embodiments may not be applied independently of each other, but applied as a plurality of embodiments. For example, as shown in FIG. 28, the loudspeaker 200 may include a plurality of drivers 220 and 230, and the unit accommodator 211 may be formed in a rounded shape to make a curved first sound output passage A. Further, the loudspeaker 200 of this embodiment may further include the sound absorber 400.

Thus, it is possible to provide a sound of improved sound quality.

When the loudspeaker 200 includes a plurality of drivers, the drivers may be provided to output sounds through different sound output passages, respectively. In this regard, detailed descriptions about the configuration according to this embodiment will be described with reference to FIG. 29.

As described above, the loudspeaker 200 may further include the second driver 230. The unit accommodator 211 may include a first unit accommodator 211*d* provided with the first driver 220 and facing toward a first inner surface 213*a* of the slot forming portion 213, and a second unit accommodator 211*e* having an inner edge spaced apart from the inner edge of the first unit accommodator 211*d* and provided with the second driver 230 facing toward a second inner surface 213*b* of the slot forming portion 213. The second inner surface 213*b* of the slot forming portion 213 may form a third sound output passage C in an opposite direction to the first sound output passage A. In this case, it is possible to reduce a distortion of sound quality due to interference between the drivers, as compared with that of the embodiment shown in FIG. 27 where the first driver 220 and the second driver 230 are provided side by side to respectively output the sounds through one output passage.

In other words, the sounds respectively output from the drivers may be output through different sound output passages, thereby not only separating output sound ranges according to the drivers, but also reducing a distortion of sound quality due to interference between the drivers.

Further, the loudspeaker according to this embodiment may further include a barrier wall 216 connecting the inner edge of the first unit accommodator 211*d* and the first inner surface of the slot forming portion 213 and blocking the inside of the first sound output passage A. With the barrier wall 216, the first sound output passage A and the third sound output passage C are more clearly partitioned from each other. Further, the back waves, the sound waves generated behind the drivers 220 and 230, may radiate toward only the third sound output passage C.

Thus, a distortion of sound quality due to interference between the drivers may be further reduced.

Figure 30:
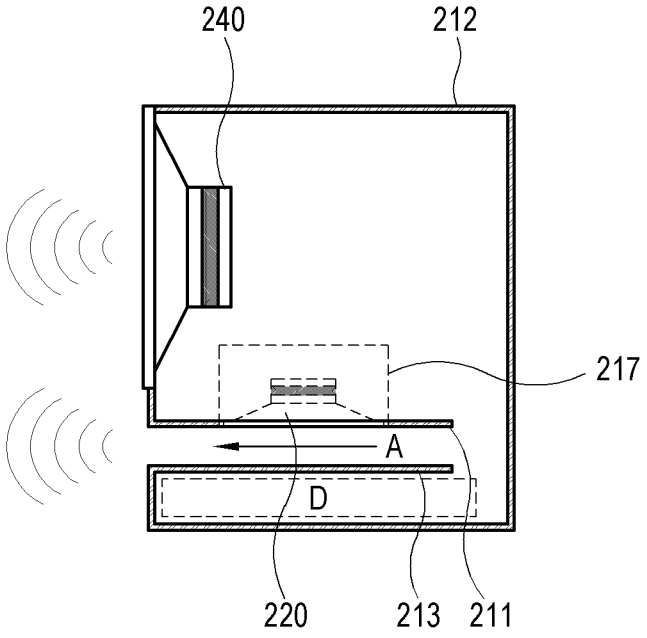
FIG. 30 illustrates a lateral cross-section view of a loudspeaker including a slot portion disposed below a plurality of drivers according to another embodiment.

Referring to FIG. 30, the space forming portion 212 may further include a hole in which a third driver 240 is provided and the third driver may output a sound toward the outside of the space forming portion 212. On the contrary to the foregoing drawings, FIG. 30 illustrates the loudspeaker turned upside down. That is, contrary to the foregoing drawings where the slot forming portion 213 is disposed above the space forming portion 212 and thus the first sound output passage A is also provided above the first driver 220, FIG. 30 illustrates that the slot forming portion 213 is disposed below the space forming portion 212 and the first sound output passage A is also provided below the first driver 220. In this embodiment, the operations and effects of the first driver 220 are similar to those of the foregoing embodiments, but the first sound output passage A serves as the port 500 for the third driver 240. Further, the slot forming portion 213 may be bent along the first sound output passage A to form a space D underneath the slot forming portion 213. In this case, both sounds output from the first driver 220 and the third driver 240 have an additional sound path.

Thus, it is possible to not only divide and reproduce output sound ranges according to the drivers, but also reinforce a bass sound output from the third driver 240.

Figure 31:
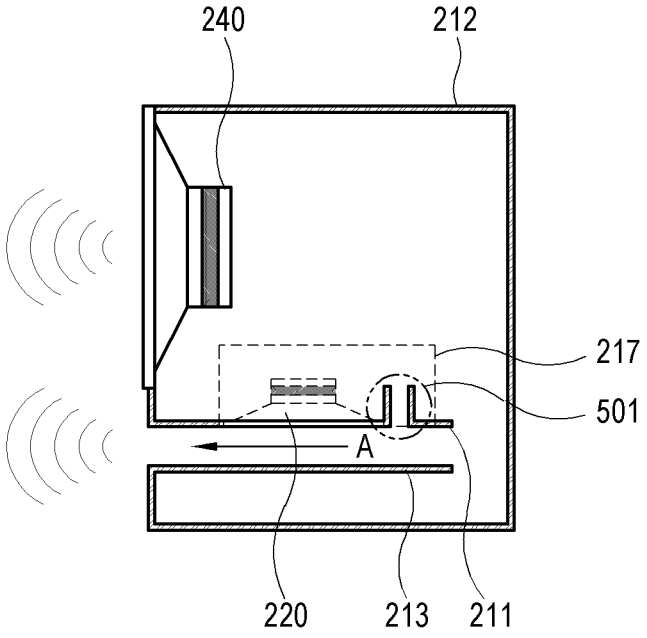
FIG. 31 illustrates a lateral cross-section view of a loudspeaker including a second slot portion channeled to a first slot portion disposed below a plurality of drivers according to another embodiment.
Figure 32:
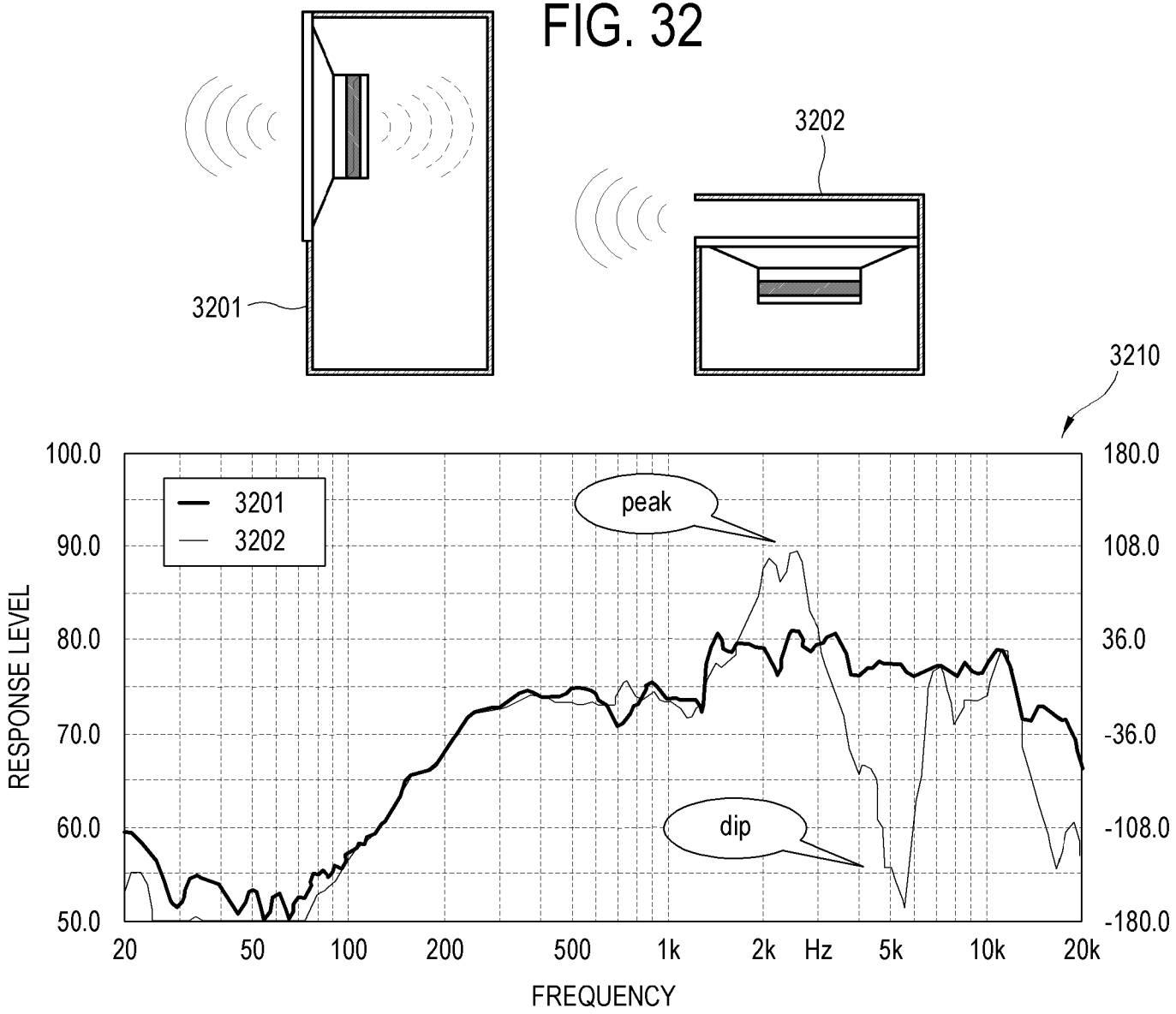
FIG. 32 illustrates embodiments and effects of a related art.

Further, referring to FIG. 31, as another alternative embodiment, the unit accommodator 211 may further include a third space forming portion 217 surrounding the back of the first driver 220, and a second port 501 through which the back waves generated by the first driver 220 and the third driver 240 travel through the second port 501 and to the first sound output passage A. In this case, the first driver 220 and the third driver 240 respectively have chambers divided from each other, thereby decreasing interference therebetween and reinforcing a bass range with respect to the sound output from the first driver 220.

Thus, it is possible to provide a higher sound quality and characteristic suitable for circumferences.

As described above, the electronic apparatus may provide improved sound quality.

According to one or more embodiments described herein, it is possible to provide an electronic apparatus with a loudspeaker with improved sound quality.

Although a few embodiments have been shown and described, it may be appreciated by those skilled in the art that changes and modifications may be made in these embodiments without departing from the principles and spirit of the present disclosure, the scope of which is defined in the appended claims and their equivalents.

What is claimed is:

1. An electronic apparatus comprising:

a loudspeaker comprising:

an enclosure;

a first driver disposed in the enclosure and configured to output a sound based on an input audio signal;

a unit accommodator having a hole in which the first driver is disposed, and extending toward an inside of the enclosure;

a space forming portion extended from an outer edge of the unit accommodator, surrounding a back of the first driver to form a space with the unit accommodator, and spaced apart from an inner edge of the unit accommodator, wherein the sound provided in the back of the first driver travels through the space formed between the space forming portion and the inner edge of the unit accommodator;

a slot forming portion extending from the space forming portion, and having an inner surface spaced apart from an outer surface of the unit accommodator to form a first sound output passage; and a sound absorber disposed at at least one of the outer surface of the unit accommodator or the inner surface of the slot forming portion and disposed in between the first driver and the inner edge of the unit accommodator to absorb the sound traveled through the space forming portion.

2. The electronic apparatus according to claim 1, wherein the first driver is configured to generate a back wave toward the space forming portion, the back wave traveling through the first sound output passage.

3. The electronic apparatus according to claim 1, wherein the sound absorber seals the first sound output passage.

4. The electronic apparatus according to claim 1, wherein the sound absorber comprises at least one of an uneven portion or a plurality of slits on the outer surface of the unit accommodator along the first sound output passage.

5. The electronic apparatus according to claim 1, wherein the unit accommodator comprises at least one of a flat plate shape, a polygonal shape, or a rounded flat plate shape.

6. The electronic apparatus according to claim 1, wherein the unit accommodator is curved with the first sound output passage.

7. The electronic apparatus according to claim 1, wherein the enclosure further comprises a protrusion extending from the inner surface of the space forming portion, and wherein the protrusion is a flat plate and has an end portion spaced apart from the inner edge of the unit accommodator.

8. The electronic apparatus according to claim 1, wherein the enclosure further comprises a port forming a second sound output passage in an area of the space forming portion behind the first driver.

9. The electronic apparatus according to claim 1, wherein the loudspeaker comprises a second driver provided adjacent to the first driver.

10. The electronic apparatus according to claim 9, wherein the loudspeaker comprises a second space forming portion surrounding a back of the second driver.

11. The electronic apparatus according to claim 1, further comprising a second driver, wherein the unit accommodator further comprises:

a first unit accommodator provided with the first driver to face toward a first inner surface of a first slot forming portion forming the first sound output passage therebetween; and a second unit accommodator comprising a second inner edge spaced apart from a first inner edge of the first unit accommodator, and provided with the second driver to face toward a second inner surface of a second slot forming portion, wherein the second inner surface of the second slot forming portion forms a third sound output passage in an opposite direction to the first sound output passage.

12. The electronic apparatus according to claim 11, wherein the electronic apparatus further comprises a display.

13. The electronic apparatus according to claim 1, wherein the first driver is spaced apart at a predetermined distance from the outer edge of the unit accommodator.

14. The electronic apparatus according to claim 1, further comprising a third driver provided in a second hole of the space forming portion.

15. The electronic apparatus according to claim 14, further comprising a third space forming portion surrounding the back of the first driver, and a second port through which the third space forming portion is connected to the first sound output passage.

16. A loudspeaker comprising:

a driver configured to emit sound;

a unit accommodator comprising the driver and a back slot portion adjacent to the driver;

a space forming portion connected to an outer edge of the unit accommodator;

a slot forming portion connected to the space forming portion, wherein the slot forming portion is spaced apart from the unit accommodator and an inner surface of the slot forming portion faces a front side of the driver; and a sound absorber disposed at at least one of an outer surface of the unit accommodator or the inner surface of the slot forming portion and disposed in between the driver and an inner edge of the unit accommodator to absorb the sound traveled through the space forming portion.

* * * * *